US008567916B2

(12) United States Patent
Tsuchiya et al.

(10) Patent No.: US 8,567,916 B2
(45) Date of Patent: Oct. 29, 2013

(54) LIQUID SUPPLYING MECHANISM AND LIQUID EJECTING APPARATUS

(75) Inventors: Kenji Tsuchiya, Nagano (JP); Hiroshige Owaki, Okaya (JP); Hirokazu Ono, Okaya (JP); Takeo Seino, Nagano (JP); Hiroyuki Hagiwara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/330,155

(22) Filed: Dec. 19, 2011

(65) Prior Publication Data

US 2012/0162322 A1 Jun. 28, 2012

(30) Foreign Application Priority Data

Dec. 22, 2010 (JP) ..... 2010-285977
Dec. 22, 2010 (JP) ..... 2010-285978
Dec. 22, 2010 (JP) ..... 2010-285979
Dec. 22, 2010 (JP) ..... 2010-285980
Dec. 22, 2010 (JP) ..... 2010-285981

(51) Int. Cl.
*B41J 2/05* (2006.01)

(52) U.S. Cl.
USPC ..... 347/66

(58) Field of Classification Search
USPC ..... 347/66, 67, 85, 86, 87
See application file for complete search history.

(56) References Cited

U.S. PATENT DOCUMENTS 5,160,945 A * 11/1992 Drake ..... 347/42
6,250,738 B1 * 6/2001 Waller et al. ..... 347/42
6,264,313 B1 * 7/2001 Mackowiak et al. ..... 347/85
6,488,368 B2 * 12/2002 Petersen et al. ..... 347/85
2009/0295867 A1 12/2009 Oguchi

FOREIGN PATENT DOCUMENTS

JP 2010-006049 1/2010

* cited by examiner

*Primary Examiner* — Anh T. N. Vo
(74) *Attorney, Agent, or Firm* — Workman Nydegger

(57) ABSTRACT

A liquid supplying mechanism includes a flow channel forming member that has a base having a plate-like shape on which an upstream portion of a plurality of liquid supplying flow channels are formed so as to supply ink to each of a plurality of liquid ejection heads that are assembled to a liquid ejection head unit, and a plurality of connection members in a tubular shape that extend from one side of the of the base so as to form a downstream portion of the flow channels that individually communicate with the upstream portion of the respective liquid supplying flow channels and are disposed such that the distal end of the connection members correspond to the positions of the connection holes that are formed on the respective liquid ejection heads.

10 Claims, 8 Drawing Sheets

LIQUID SUPPLYING MECHANISM AND LIQUID EJECTING APPARATUS

BACKGROUND

This application claims priority to Japanese Patent Application Nos. 2010-285977, filed Dec. 22, 2010, 2010-285978, filed Dec. 22, 2010, 2010-285979, filed Dec. 22, 2010, 2010-285980, filed Dec. 22, 2010, and 2010-285981, filed Dec. 22, 2010, which applications are expressly incorporated herein by reference.

TECHNICAL FIELD

The present invention relates to a liquid supplying mechanism that supplies liquid such as ink and liquid ejecting apparatuses having the liquid supplying mechanism.

RELATED ART

JP-A-2010-6049 discloses an ink jet printer as a liquid ejecting apparatus in which ink (liquid) is supplied to liquid ejection heads through flexible tubes and the supplied ink is ejected from a liquid ejection head unit having a plurality of unitized liquid ejection heads, thereby performing a printing process on a sheet of paper or the like. In the printer of JP-A-2010-6049, ink is supplied to the liquid ejection head unit through main flow channel members and the supplied ink is delivered to a plurality of liquid ejection heads through branch flow channel forming members that are connected to a downstream portion of the main flow channel members.

However, since each of the branch flow channel forming members in the printer of JP-A-2010-6049 is formed of a flexible tube, it is necessary to connect each of the flexible tubes to the respective liquid ejection heads while bending the flexible tubes one by one. This causes a problem in that laborious work is required for connection operation of the flow channels.

In addition, there is a further problem in that the apparatus becomes large since a space in the apparatus is necessary to place the flexible tubes which is bent around the liquid ejection heads.

It has been proposed that liquid supplying flow channels that are formed on the flow channel forming member having a plate-like shape, instead of the flexible tubes, be connected to the liquid ejection heads, thereby reducing the size of the apparatus.

However, as the thickness of the flow channel forming member having a plate-like shape is reduced in order to reduce the size of the apparatus, deformation such as warpage is more likely to occur. Further, if such a deformed flow channel forming member is connected to the liquid ejection head, the liquid ejection head whose position has already been adjusted may be displaced due to a pressing force which is applied from the flow channel forming member to the liquid ejection head.

Further, deformation such as warpage may also occur when the flow channel forming member is made of a resin material in order to reduce the thickness. It has been proposed that a reinforcement member made of a material such as a sheet metal having high rigidity be secured to the flow channel forming member, thereby correcting the deformation. Since a metal material such as a sheet metal often has a heat conductivity and a heat storage capacity greater than that of a resin material, the heat generated from the liquid ejection head or the like is stored in the reinforcement member, which in turn heats the ink in the liquid supplying flow channel, thereby altering the properties of ink and resulting in poor printing.

Moreover, the liquid ejection heads, whose positions have been adjusted with respect to each other, are held by a platform (holding frame), while a main flow channel holding member that holds the main flow channel member is secured to the platform by screws. As a consequence, when the main flow channel holding member is secured to the platform by screws, the rotation force from the screws causes the platform to be displaced, resulting in displacement of the liquid ejection heads. Such a problem is not limited to the case where the main flow channel holding member is secured to the platform by screws, but may also occur in the case where any component that constitutes the liquid supplying mechanism for supplying liquid to the liquid ejection heads, such as a flow channel forming member on which liquid supplying flow channels are formed, is secured to the holding frame that holds the liquid ejection heads.

SUMMARY

An advantage of some aspects of the invention is that a liquid supplying mechanism and a liquid ejecting apparatus capable of simplifying connection operation to connect the flow channels to the liquid ejection head unit, reducing the size of the apparatus, suppressing heat transfer to the liquid supplying flow channels and suppressing displacement of the liquid ejection heads are provided.

According to an aspect of the invention, a liquid supplying mechanism includes a flow channel forming member that has a base having a plate-like shape on which an upstream portion of a plurality of liquid supplying flow channels are formed so as to supply liquid to each of a plurality of liquid ejection heads that are assembled to a liquid ejection head unit, and a plurality of connection members in a tubular shape that extend from one side of the of the base so as to form a downstream portion of the flow channels that individually communicate with the upstream portion of the respective liquid supplying flow channels and are disposed such that the distal end of the connection members correspond to the positions of the connection holes that are formed on the respective liquid ejection heads.

With this configuration, a plurality of tubular connection members that extend from one side of the base can be insertedly connected to the respective connection holes formed on the corresponding liquid ejection heads by moving the base of the flow channel forming member in an extending direction of the connection member, thereby enabling connection operation of a plurality of pairs of the liquid ejection heads and the liquid supplying flow channels to be simultaneously achieved. Therefore, connection operation of the flow channels with the liquid ejection head unit can be simplified, compared with the case of connecting each branch flow channel forming member of a plurality of branch flow channel forming members formed by flexible tubes one by one to the connection hole of the corresponding liquid ejection head.

It is preferable that, in the liquid supplying mechanism, the connection members which are each formed as a pipe tube independently extend in parallel to each other from positions spaced apart from each other at a distance corresponding to the positions of the respective liquid ejection heads on the one side of the base.

With this configuration, the connection members are each formed as a pipe tube independently extend in parallel to each other, which differ from those formed by flexible tubes, thereby enabling the connection members to be insertedly connected to the corresponding connection holes with ease, while suppressing a significant bending. Too high rigidity of the connection member may contribute to displacement of the liquid ejection head, which occurs due to a pressing force generated during insertion connection, if the liquid ejection head or the connection member has a manufacturing tolerance. The connection members, which independently extend in parallel to each other, have a lower rigidity compared to the case where the connection members are connected with each other and integrally formed. Therefore, even if intervals between the positions of the liquid ejection heads or the positions of the connection holes have a tolerance, displacement of the liquid ejection heads can be suppressed by a slight bending of the connection member.

It is preferable that the liquid supplying mechanism further includes a reinforcement member having a plate-like shape that is made of a material having a rigidity higher than that of the flow channel forming member and is secured to the flow channel forming member so as to be parallel to the base, wherein a plurality of through holes through which the respective connection members are inserted are formed on the reinforcement member, and the through hole has an inner diameter slightly larger than an outer diameter of the connection member such that a gap is formed between the connection member and the through hole when the connection member is inserted.

With this configuration, deformation such as warpage which may occur as the thickness of the base is reduced can be corrected by the reinforcement member. This makes it possible to achieve a small-sized apparatus with the thinner base and suppress displacement of the liquid ejection head due to a pressing force which may be generated if the flow channel forming member having deformed base is connected. Further, when the connection member is inserted into the through hole, bending of the connection member connected with the liquid ejection head is acceptable, since a gap is formed between the through hole and the connection member in the radial direction of the connection member. Therefore, even if the liquid ejection head or the connection member has a manufacturing tolerance or the like, the connection member may have a slight bending when the liquid ejection head is connected to the connection hole, thereby enabling to suppress displacement of the liquid ejection heads.

It is preferable that, in the liquid supplying mechanism, an abutment section extends from the one side of the base and has a length in an extending direction of the connection member which is shorter than that of the connection member, and the abutment section abuts the reinforcement member when the reinforcement member is secured, thereby positioning the reinforcement member with respect to the flow channel forming member in the extending direction.

With this configuration, when the reinforcement member is secured, a gap can be formed between the base and the reinforcement member in an extending direction of the connection member by the abutment section of the base abutting the reinforcement member, thereby permitting bending of the connection member connected with the liquid ejection head. Therefore, even if the liquid ejection head or the connection member has a manufacturing tolerance or the like, the connection member may have a slight bending when the liquid ejection head is connected to the connection hole, thereby enabling to suppress displacement of the liquid ejection heads.

According to another aspect of the invention, a liquid ejecting apparatus includes a liquid ejection head unit to which a plurality of liquid ejection heads are assembled, and the above liquid supplying mechanism.

According to another aspect of the invention, a liquid supplying mechanism includes a flow channel forming member that has a base having a plate-like shape on which liquid supplying flow channels are formed so as to supply liquid to liquid ejection heads, and a reinforcement member having a plate-like shape made of a material having a rigidity higher than that of the base and is secured to the flow channel forming member.

With this configuration, deformation such as warpage which may occur as the thickness of the base is reduced can be corrected by securing the reinforcement member to the flow channel forming member. Further, since the reinforcement member is made of a material having a rigidity higher than that of the base, the thickness of the apparatus can be reduced by securing the reinforcement member in parallel to the base, rather than by increasing the thickness of the base to such an extent that deformation of the base can be suppressed. Therefore, it is possible to achieve a small-sized apparatus with the thinner base and suppress displacement of the liquid ejection head due to a pressing force which may be generated if the flow channel forming member having deformed base is connected.

It is preferable that, in the liquid supplying mechanism, the reinforcement member is disposed between the liquid ejection head and the base.

With this configuration, the reinforcement member is disposed between the liquid ejection head and the base. The operator connects/disconnects the flow channel forming member, grabbing the reinforcement member, therefore deformation of the base during connection/disconnection can be suppressed.

It is preferable that, in the liquid supplying mechanism, the liquid supplying flow channel is formed by covering a recess formed as a groove on the base with a film member which is affixed to the base so as to cover the recess.

With this configuration, although the base may deform when the film member is affixed thereto, deformation of the base can be corrected by securing the reinforcement member to the flow channel forming member.

It is preferable that, in the liquid supplying mechanism, the flow channel forming member is made of a resin material and the reinforcement member is made of a metal material, and, when the flow channel forming member is connected to the liquid ejection head, the reinforcement member holds the liquid ejection head and is grounded via a holding frame that is made of a metal material.

With this configuration, the reinforcement member is grounded via the holding frame, therefore it is possible to suppress electrostatic charge by establishing a discharge path for static electricity of the reinforcement member and suppress generation of electromagnetic noise. Moreover, when the liquid ejection head generates heat, it is also possible to promote heat dissipation of the liquid ejection head by transferring heat via the holding frame to the reinforcement member having a plate-like shape.

It is preferable that, in the liquid supplying mechanism, abutment sections extend from one side of the base which opposes the reinforcement member in a direction toward the reinforcement member and are disposed in pairs with one of each pair being disposed on either edge of the base opposing with each other.

With this configuration, when the operator removes the flow channel forming member from the holding frame, grabbing the reinforcement member with his/her both hands, the abutment section formed on the base abuts the reinforcement member, therefore bending of the base can be suppressed.

According to another aspect of the invention, a liquid ejecting apparatus includes a liquid ejection head from which liquid is ejected, and the above liquid supplying mechanism.

According to another aspect of the invention, a liquid supplying mechanism includes a flow channel forming member that has a base having a plate-like shape and is provided with a flow channel forming area on which liquid supplying flow channels are formed so as to supply liquid to liquid ejection heads and a non-flow channel forming area on which the liquid supplying flow channels are not formed, and a reinforcement member having a plate-like shape which is secured to the flow channel forming member so as to oppose the non-flow channel forming area on the base.

With this configuration, deformation such as warpage of the base can be corrected by securing the reinforcement member to the flow channel forming member, therefore it is possible to achieve a small-sized apparatus with the thinner base. The reinforcement member is secured to the flow channel forming member so as to oppose the non-flow channel forming area on which the liquid supplying flow channels are not formed. Accordingly, even if heat generated from the liquid ejection head or the like is stored in the reinforcement member, heat transfer to the flow channel forming area can be suppressed. Therefore, it is possible to reduce the size of the apparatus and suppress heat transfer to the liquid supplying flow channel.

It is preferable that, in the liquid supplying mechanism, the flow channel forming area is disposed at the approximate center of the base, while the non-flow channel forming area is disposed at the peripheral area of the base so as to surround the flow channel forming area. The reinforcement member has an aperture disposed at a position that corresponds to the flow channel forming area.

With this configuration, since the non-flow channel forming area is disposed at the peripheral area of the base so as to surround the flow channel forming area which is disposed at the approximate center of the base, deformation of the base can be more uniformly corrected by securing the reinforcement member to the non-flow channel forming area. Further, since the reinforcement member has the aperture at a position that corresponds to the flow channel forming area, heat transfer to the liquid supplying flow channel can be suppressed by placing the flow channel forming area and the reinforcement member spaced apart. In addition, since the aperture is formed at the approximate center of the reinforcement member, the reinforcement member can be simplified in shape and the reinforcement member can be of a light-weight.

It is preferable that, in the liquid supplying mechanism, the reinforcement member is made of a metal material and is disposed between the holding frame that holds the liquid ejection heads and the base, and the holding frame is made of a metal material.

With this configuration, since the reinforcement member is disposed between the holding frame and the base, it is possible to promote heat dissipation by the reinforcement member and the holding frame both having high heat conductivity, when the liquid ejection head generates heat.

It is preferable that, in the liquid supplying mechanism, the base is made of a resin material and is disposed between the holding frame that holds the liquid ejection heads and the reinforcement member, and the holding frame is made of a metal material.

With this configuration, since the base which is made of a resin material is disposed between the holding frame and the reinforcement member, it is possible to suppress the heat of the liquid ejection head to be transferred to the reinforcement member via the metallic holding frame.

It is preferable that, in the liquid supplying mechanism, the abutment section extends from one side of the base which opposes the reinforcement member so that the abutment section abuts the reinforcement member when the reinforcement member is secured to the flow channel forming member, thereby positioning the reinforcement member.

With this configuration, when the reinforcement member is secured to the flow channel forming member, the abutment section that extends from the base of the flow channel forming member abuts the reinforcement member, thereby positioning the reinforcement member. Accordingly, heat transfer from the reinforcement member to the flow channel forming member can be suppressed by reducing the contact area between the reinforcement member and the base.

According to another aspect of the invention, a liquid ejecting apparatus includes a liquid ejection head from which liquid is ejected, and the above liquid supplying mechanism.

With this configuration, the same operation and effect as those of the above liquid supplying mechanism can be obtained.

According to another aspect of the invention, a securing configuration for securing a flow channel forming member to a liquid ejection head includes a first securing member that secures a reinforcement member having a plate-like shape to the flow channel forming member that has a base having a plate-like shape on which liquid supplying flow channels are formed so as to supply liquid to liquid ejection heads, and a second securing member that secures a flow channel unit composed of the flow channel forming member and the reinforcement member which are secured to each other by the first securing member to a holding frame that holds the liquid ejection heads.

With this configuration, deformation such as warpage of the base of the flow channel forming member can be corrected by the reinforcement member when the reinforcement member is secured to the flow channel forming member by the first securing member. Then, the flow channel forming member having the base whose deformation has been corrected, integrally with the reinforcement member, is secured by the second securing member to the holding frame that holds the liquid ejection heads, thereby enabling to suppress displacement of the liquid ejection head. Therefore, it is possible to reduce the size of the apparatus by using the flow channel forming member that has the base having a plate-like shape, instead of the flexible tubes, and suppress displacement of the liquid ejection head.

It is preferable that, in the securing configuration for securing a flow channel forming member to a liquid ejection head, the liquid supplying flow channels are formed by covering a recess formed as a groove on the base of the flow channel forming member with a film member which is affixed to the base so as to cover the recess.

With this configuration, although the base may deform when the film member is affixed thereto, deformation of the base can be corrected by securing the reinforcement member to the flow channel forming member.

It is preferable that, in the securing configuration for securing a flow channel forming member to a liquid ejection head, the reinforcement member is made of a material having a rigidity higher than that of the base.

With this configuration, since the reinforcement member is made of a material having a rigidity higher than that of the base, the apparatus can be reduced in size by securing the reinforcement member to the base in parallel to the base, rather than by increasing the thickness of the base to such an extent that deformation of the base can be suppressed It is preferable that, in the securing configuration for securing a flow channel forming member to a liquid ejection head, the flow channel forming member is made of a resin material, while the reinforcement member and the holding frame are made of a metal material, the reinforcement member is grounded via the holding frame when the flow channel unit is secured to the holding frame.

With this configuration, the reinforcement member is grounded via the holding frame when secured to the holding frame, therefore it is possible to suppress electrostatic charge by establishing a discharge path for static electricity and suppress generation of electromagnetic noise of the reinforcement member. Moreover, when the liquid ejection head generates heat, it is also possible to promote heat dissipation of the liquid ejection head by transferring heat via the holding frame to the reinforcement member.

According to another aspect of the invention, a process for securing a flow channel forming member to a liquid ejection head includes a first securing process for securing a reinforcement member having a plate-like shape to the flow channel forming member that has a base having a plate-like shape on which liquid supplying flow channels are formed so as to supply liquid to liquid ejection heads, and a second securing process for securing a flow channel unit composed of the flow channel forming member and the reinforcement member which are secured to each other in the first securing process to a holding frame that holds the liquid ejection heads.

With this configuration, the same operation and effect as those of the above configuration can be obtained.

According to another aspect of the invention, a screw tightening configuration of a liquid ejection head holding mechanism includes a projection that is formed on one of a holding frame that holds liquid ejection heads and a component to be secured to the holding frame by using the tightening force of a screw so as to project from one of opposing positions in the axial direction of the screw toward the other, the screw being collapsed and deformed by a rotation force applied from the screw during tightening of the screw and a reaction force applied from the other.

With this configuration, during tightening of the screw, the projection is collapsed and deformed, thereby suppressing transmission of the rotation force to the holding frame via the component to be secured. Consequently, the component to be secured can be secured while suppressing displacement of the holding frame. As a result, displacement of the liquid ejection head can be suppressed when the flow channel forming member is secured to the holding frame that holds the liquid ejection heads by using the tightening force of the screw.

It is preferable that, in the screw tightening configuration of a liquid ejection head holding mechanism, an insertion hole through which the screw is inserted is formed on the component to be secured, and the projection is formed in an annular shape so as to surround the insertion hole and is disposed on the component to be secured on the side opposite the holding frame in the axial direction of the screw.

With this configuration, the projection is formed in an annular shape so as to surround the insertion hole, therefore the rotation force transmitted to the holding frame in the rotation direction of the screw can be uniformly suppressed.

It is preferable that, in the screw tightening configuration of a liquid ejection head holding mechanism, the component to be secured is a flow channel forming member that has a base having a plate-like shape on which liquid supplying flow channels are formed so as to supply liquid to the liquid ejection heads, and at least three projections project from one side of the base opposite the holding frame.

With this configuration, at least three projections project from one side of the base having a plate-like shape, therefore it is possible to secure the flow channel forming member to the holding frame by using the tightening force of the screw, while suppressing the inclination of the base.

It is preferable that, in the screw tightening configuration of a liquid ejection head holding mechanism, a reinforcement member having a plate-like shape is disposed between the component to be secured and the holding frame, and the projection has a length longer than that of the reinforcement member in the axial direction of the screw.

With this configuration, the projection has a length longer than that of the reinforcement member in the axial direction of the screw, therefore it is possible that the projection abuts the holding frame even if the reinforcement member is placed between the component to be secured and the holding frame.

It is preferable that, in the screw tightening configuration of a liquid ejection head holding mechanism, an abutment section is formed so as to surround the projection and disposed on the component to be secured so as to abut the reinforcement member for the positioning of the reinforcement member, and the abutment section has a length shorter than that of the projection in the axial direction of the screw and a rigidity higher than that of the projection.

With this configuration, the abutment section has a length shorter than that of the projection in the axial direction of the screw and a rigidity higher than that of the projection, therefore it is possible that the abutment section remains in the original shape when the projection is collapsed and deformed during tightening of the screw, thereby enabling the positioning of the reinforcement member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
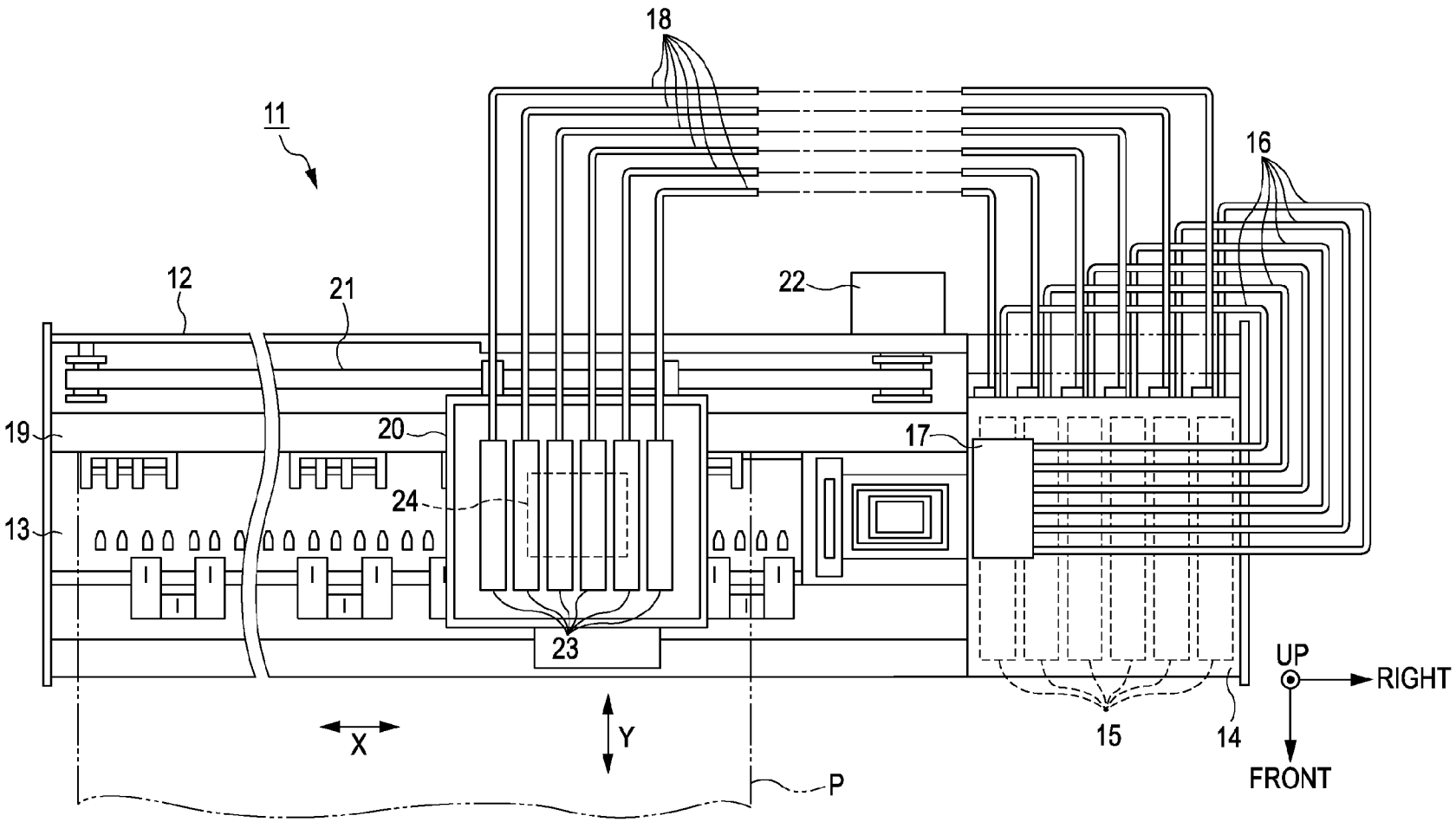
FIG. 1 is a plan view of an embodiment of a liquid ejecting apparatus according to the invention.

An embodiment of a liquid ejecting apparatus according to the present invention which is embodied as an ink jet printer (hereinafter also referred to as "printer") will be described below with reference to the drawings. The terms "front-back direction," "left-right direction" and "up-down direction" as used herein are defined by the arrows shown in the drawings, which indicate the up direction, right direction and front direction. Further, the circle having a dot inside represents the arrow as viewed from the tip, indicating that the arrow extends through the drawing from the back side to the front side, while the circle having a cross inside represents the arrow as viewed from the tail, indicating that the arrow extends through the drawing from the front side to the back side.

As shown in FIG. 1, a printer 11 of this embodiment has a support member 13 that is disposed in a frame 12 and is configured such that a sheet P is transported on the support member 13 in a transportation direction Y that intersects with a main scan direction X, which is a longitudinal direction of the frame 12.

A cartridge holder 14 is disposed at one end of the frame 12 in the longitudinal direction (right side in FIG. 1) so that a plurality of ink cartridges 15 for storing ink as an example of a liquid are detachably loaded on the cartridge holder 14. In this embodiment, six ink cartridges 15 that store different colors of ink respectively (for example, black, cyan, magenta, yellow, light cyan and light magenta) are loaded on the cartridge holder 14.

A pressurizing pump 17 that supplies pressurized air into the respective ink cartridges 15 via air supplying tubes 16 is disposed above the cartridge holder 14. The ink cartridges 15 are connected to upstream ends of respective flexible ink supplying tubes 18.

A guide shaft 19 is formed in the frame 12 so as to extend in the main scan direction and support a carriage 20 in a slidable manner. The carriage 20 is connected to a carriage motor 22 via a timing belt 21 and is configured to reciprocate along the guide shaft 19 in the main scan direction X when driven by the carriage motor 22.

A plurality of valve units 23 which correspond to the respective ink cartridges 15 are mounted on the upper portion of the carriage 20 and a liquid ejection head unit 24 is secured to the lower portion of the carriage 20. Each valve unit 23 is connected to the downstream end of the corresponding ink supplying tube 18. The pressurizing pump 17 applies pressure to the ink so that the ink is supplied from the ink cartridge 15 via the ink supplying tube 18 to the liquid ejection head unit 24 through the valve unit 23.

As mentioned above, the printer 11 is an off-carriage type printer in which ink is supplied from the ink cartridges 15 disposed on the frame 12 to the liquid ejection head unit 24 mounted on the carriage 20. The air supplying tubes 16, the pressurizing pump 17, the ink supplying tubes 18 and the valve units 23 constitute a liquid supplying mechanism that supplies ink to a liquid ejection head 26.

Figure 2:
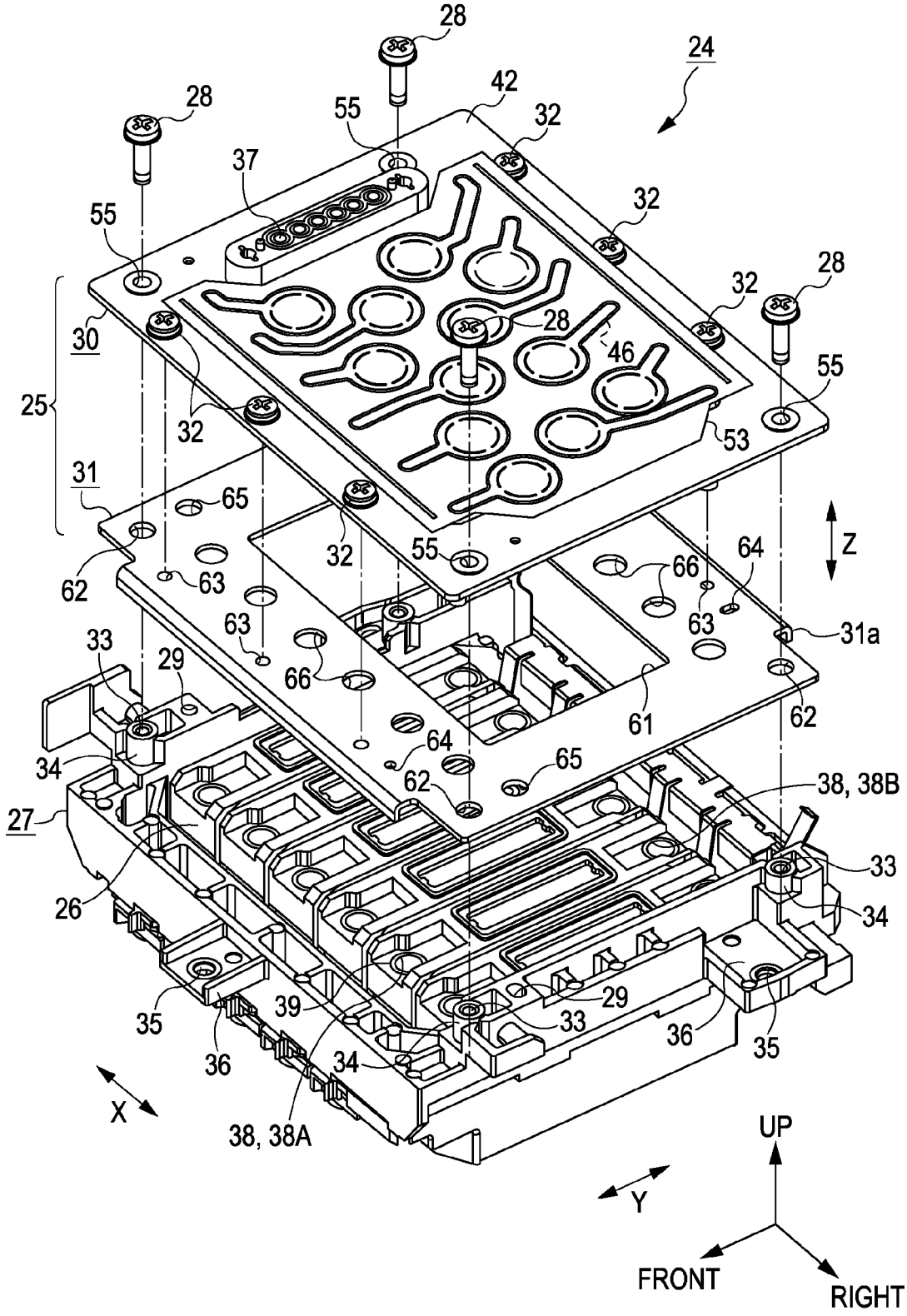
FIG. 2 is an exploded perspective view of a liquid ejection head unit seen from an upper diagonal position.

Next, the liquid ejection head unit 24 will be described below. As shown in FIG. 2, the liquid ejection head unit 24 is composed of a flow channel unit 25 and a holding frame 27 in which a plurality of (in this embodiment, six) liquid ejection heads 26 are held, which are stacked in the up-down direction and screwed together by a plurality of (in this embodiment, four) screws 28 as an example of a second securing member. Two registration holes 29 are formed on the top of the holding frame 27 at positions close to the front end, and are arranged in the main scan direction X. The registration holes 29 are provided for positioning of the flow channel unit 25 in the horizontal direction (the main scan direction X and the transportation direction Y).

The flow channel unit 25 is composed of a flow channel forming member 30 and a reinforcement member 31, which are stacked in the up-down direction and screwed together by a plurality of (in this embodiment, six) screws 32 as an example of a first securing member. The holding frame 27, flow channel forming member 30 and reinforcement member 31 constitute a liquid ejection head holding mechanism that holds the liquid ejection heads 26.

In this embodiment, the flow channel forming member 30 and the reinforcement member 31 are components that constitute the liquid supplying mechanism that supplies ink to the liquid ejection heads 26. Further, the flow channel forming member 30 is a component to be secured to the holding frame 27 by the tightening force of the screw 28.

The flow channel forming member 30 is made of a resin material such as plastic. The reinforcement member 31 is a sheet metal member having a plate-like shape which is made of a metal material having a rigidity higher than that of the flow channel forming member 30. Further, the holding frame 27 is made of a metal material such as aluminum.

The reinforcement member 31 is placed between the liquid ejection heads 26 and a base 42 when the flow channel unit 25 is secured to the holding frame 27. While the flow channel forming member 30 is connected to the liquid ejection heads 26, the reinforcement member 31 is grounded via the holding frame 27.

A screw section 34 having a screw hole 33 through which the screw 28 is screwed is provided on the top of the holding frame 27 at each of the four corners. Further, a rib 36 having an insertion hole 35 projects from each of the front, left and right ends of the holding frame 27. The liquid ejection head unit 24 is secured on the underside of the carriage 20, for example by using securing members such as screws, which are not shown, to be inserted through the respective insertion holes 35 of the ribs 36 from the underside.

A plurality of (in this embodiment, six) supply holes 37 are disposed on the top of the flow channel forming member 30 and arranged in the transportation direction Y so that ink supplied from the valve unit 23 flows therein. Further, two connection holes 38 (38A, 38B) are disposed on the top of each liquid ejection head 26 on the front end and back end, respectively, so that different colors of ink are each introduced therein. In addition, an annular sealing member 39 is provided on each connection hole 38 of the liquid ejection head 26.

Figure 3:
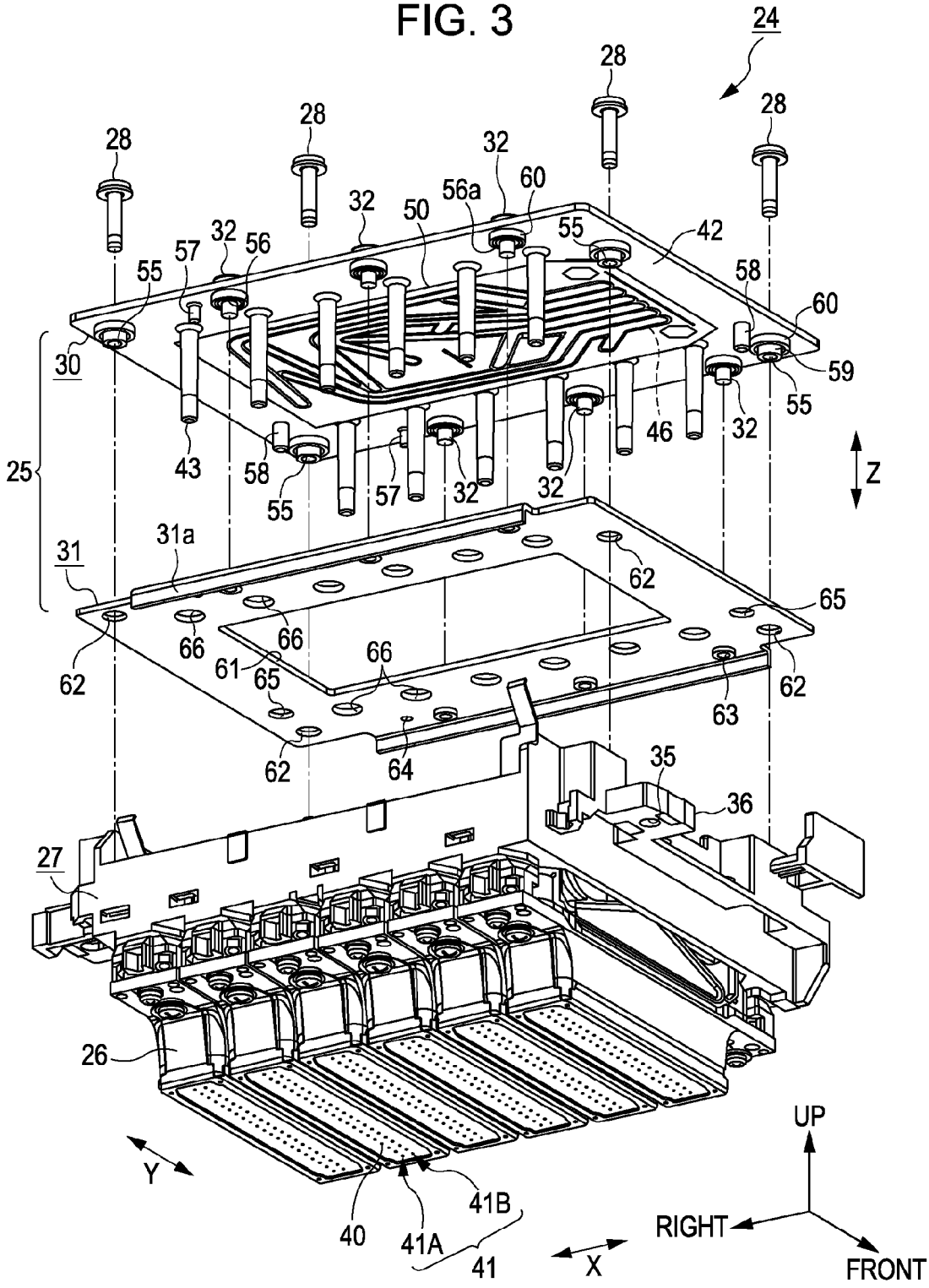
FIG. 3 is an exploded perspective view of the liquid ejection head unit seen from a lower diagonal position.

As shown in FIG. 3, a plurality of nozzles 40 are formed on the underside of each liquid ejection head 26 so that ink is ejected therethrough. A nozzle row 41 is composed of a plurality of nozzles 40 that are arrayed in a row in the transportation direction Y. The same color of ink is ejected through each nozzle row 41. Two nozzle rows (41A, 41B) are disposed on the liquid ejection head 26 and arranged in the main scan direction X. Two colors of ink each introduced through the connection holes 38 (38A, 38B) are ejected through the two nozzle rows 41 (41A, 41B), respectively.

In printing operation, the carriage 20 moves in a forward motion in the main scan direction X while ejecting ink onto the sheet P sequentially from the first nozzle row 41A in the forward motion direction. Then, after the sheet P is transported a predetermined distance, the carriage 20 moves in a backward motion in the main scan direction X while ejecting ink onto the sheet P sequentially from the first nozzle row 41B in the backward motion direction. Accordingly, during the forward and backward motion of the carriage 20, six colors of ink are superimposed in the same order in bidirectional printing.

Next, the configuration of the flow channel forming member 30 will be described below. The flow channel forming member 30 has the base 42 having a plate-like shape and a plurality of (in this embodiment, twelve) connection members 43 in a tubular shape extending from one side of the base 42 (the underside opposing the reinforcement member 31). The connection members 43 which are each formed as a pipe tube independently extend in parallel to each other and arranged in the main scan direction X spaced apart from each other at a distance corresponding to the positions of the respective liquid ejection heads 26. The pipe tube is a cylindrical tube which does not have a flexibility as high as that of a flexible tube but has a rigidity by which the tube can retain its linear shape without being deformed by the weight of itself even if the position varies. The term "parallel to each other" as used herein refers to the case not only where all the connection members 43 are exactly in parallel to each other, but also where the connection members 43 extend from one side of the base 42 in substantially the same direction even if they are inclined at a certain angle (for example, approximately five degrees).

The connection members 43 are arranged such that the distal end of the connection members 43 correspond to the positions of the connection holes 38 that are each formed on the respective liquid ejection heads 26 that individually correspond to the connection members 43. Specifically, six connection members 43 are disposed on the base 42 of the flow channel forming member 30 at positions close to the front end and are arranged in the main scan direction X so as to supply ink to the connection holes 38A (see FIG. 2) which are formed on the front side of the respective liquid ejection heads 26. Further, six connection members 43 are disposed on the base 42 of the flow channel forming member 30 at positions close to the back end and arranged in the main scan direction X so as to supply ink to the connection holes 38B (see FIG. 2) which are formed on the back side of the respective liquid ejection heads 26.

Figure 4:
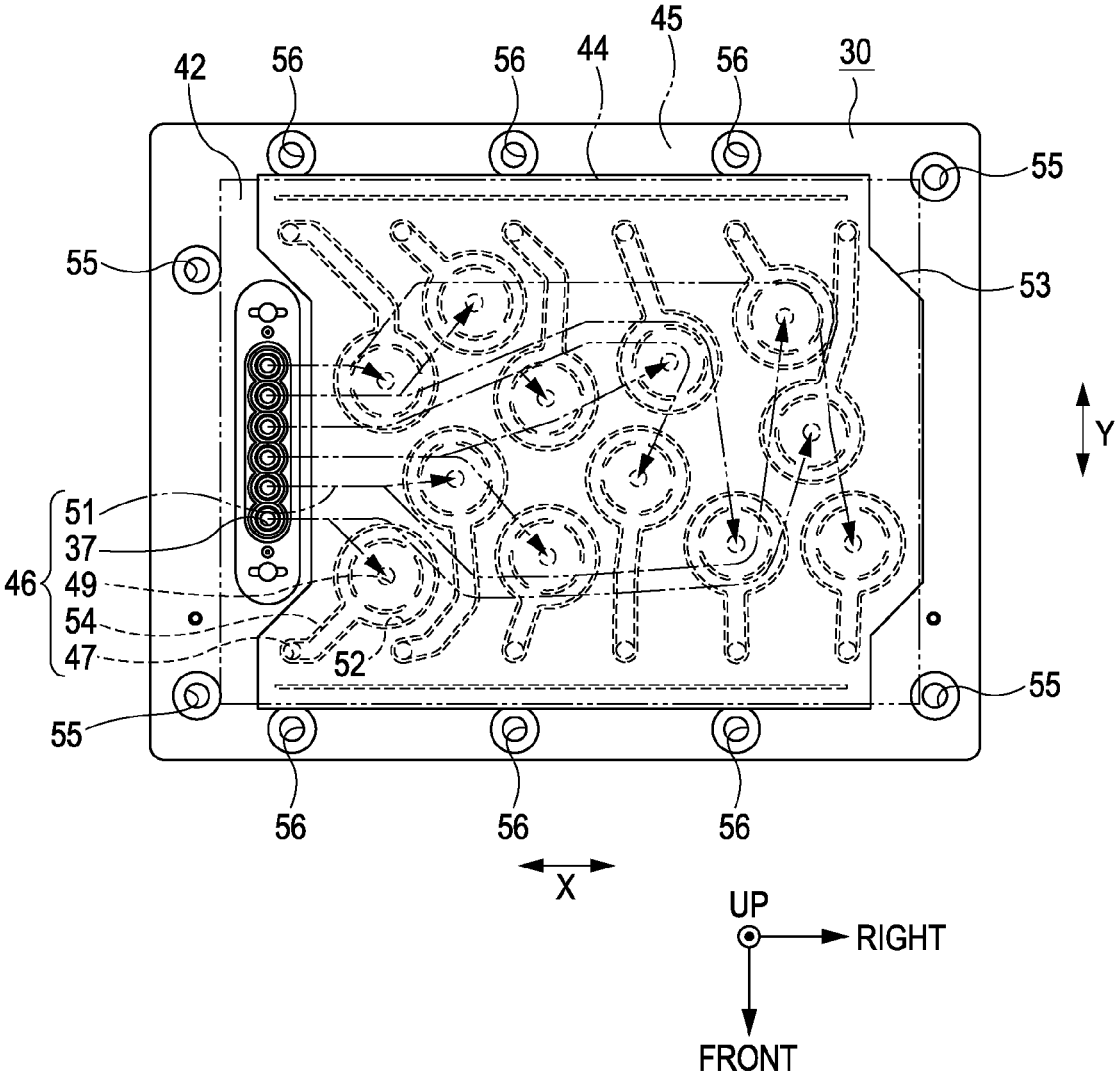
FIG. 4 is a top view of a flow channel forming member.
Figure 5:
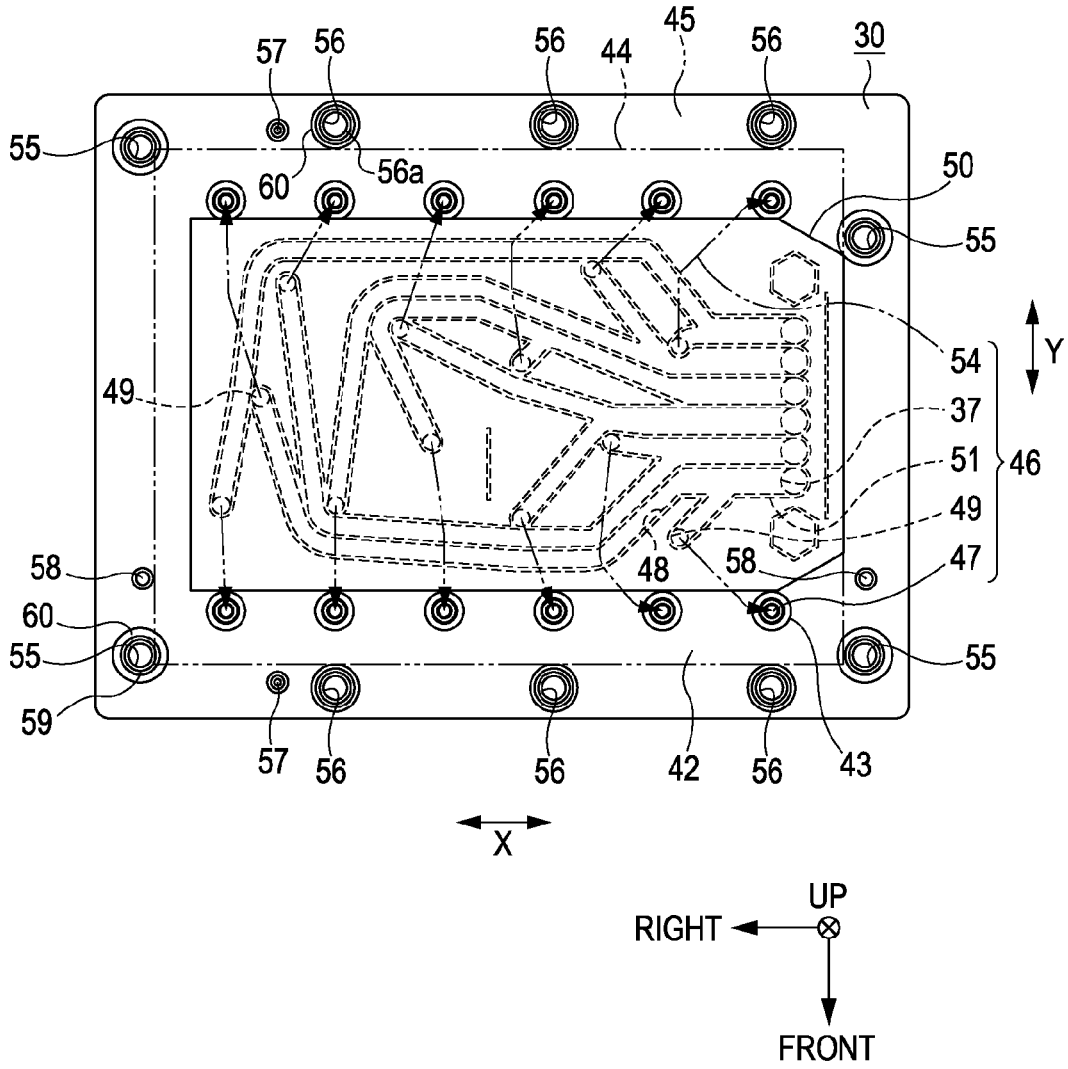
FIG. 5 is a bottom view of the flow channel forming member.

As shown in FIGS. 4 and 5, a flow channel forming area 44 is disposed on the base 42 of the flow channel forming member 30 at a position approximately at the center of the base 42. A non-flow channel forming area 45 is further disposed at the peripheral area of the base 42 so as to surround the flow channel forming area 44. The upstream portion of a plurality of liquid supplying flow channels 46 is formed within the flow channel forming area 44 on the base 42 so as to supply ink to the respective liquid ejection heads 26.

As shown in FIG. 5, first flow channels 47 are formed at the connection members 43 as a downstream portion of the liquid supplying flow channels 46, whose upstream end communicates with an upstream portion of the liquid supplying flow channels 46.

Six recesses 48 are formed on the underside of the base 42 as grooves such that each upstream end communicates with a corresponding one of the supply holes 37 and each downstream portion divides into two branches. Each downstream end of the branches of each of the recesses 48 communicates with a corresponding one of communication holes 49 that extends through the flow channel forming member 30 in the up-down direction. Then, a film member 50 is affixed to the underside of the base 42 at a position that corresponds to the flow channel forming area 44 so as to cover the six recesses 48, thereby forming second flow channels 51.

As shown in FIG. 4, twelve recesses 52 are formed on the top surface of the base 42 as grooves such that each upstream end communicates with a corresponding one of the communication holes 49 and each downstream end communicates with a corresponding one of the first flow channels 47 which is formed at the connection member 43. Then, a film member 53 is affixed to the top surface of the base 42 at a position that corresponds to the flow channel forming area 44 so as to cover the twelve recesses 52, thereby forming third flow channels 54.

After being supplied to the flow channel forming member 30 through the supply holes 37, ink flows through the second flow channels 51 into the communication holes 49 as shown by the arrows of two-dot chain lines of FIG. 4 and then through the third flow channels 54 and the first flow channels 47 as shown by the arrows of two-dot chain lines of FIG. 5. Then, ink is supplied to the liquid ejection heads 26 (see FIG. 3). That is, the supply holes 37, the second flow channels 51, the communication holes 49 and the third flow channels 54 constitute the upstream portion of the liquid supplying flow channels 46.

Four insertion holes 55 through which the screws 28 are inserted and six insertion holes 56 through which the screws 32 are inserted are formed in the non-flow channel forming area 45 on the base 42. The insertion holes 55 are disposed at positions that substantially correspond to the four corners of the flow channel forming member 30. The insertion holes 56 are disposed in pairs opposing each other in the transportation direction Y with the flow channel forming area 44 therebetween. Three pairs of the insertion holes 56 are disposed in the main scan direction X, with one of each pair being arranged at the front edge and the other at the back edge of the flow channel forming member 30.

As shown in FIG. 3, a pair of first registration projections 57 projects from the underside of the base 42 for positioning of the reinforcement member 31 in the horizontal direction when the flow channel unit 25 is formed by securing the reinforcement member 31 to the flow channel forming member 30. The pair of first registration projections 57 is disposed on the base 42 at a position close to the right end, and each of the pair are arranged in the transportation direction Y.

Similarly, a pair of second registration projections 58 projects from the underside of the base 42 for positioning of the flow channel unit 25 in the horizontal direction when connecting the flow channel unit 25 to the holding frame 27. The pair of second registration projections 58 is disposed on the base 42 at a position close to the front end, and each of the pair are arranged in the main scan direction X. The length of the second registration projection 58 in the up-down direction (that is, the amount extending from the base 42) is longer than that of the first registration projection 57.

Moreover, first annular projections 59, which is an example of an annular shaped projection that surrounds the insertion hole 55 through which the screw 28 is inserted, project from the underside of the base 42. That is, four first annular projections 59 project from the side of the flow channel forming member 30 which opposes the holding frame 27 toward the holding frame 27 in the axial direction Z of the screw 28 (the up-down direction which is an extending direction of the connection member 43) at positions that oppose the holding frame 27. Further, second annular projections 60 as an example of an abutment section are formed concentrically with the first annular projection 59 around the outer circumference of the first annular projection 59 so as to project in an annular shape around the respective first annular projection 59.

Further, third annular projections 56*a*, which is an example of an annular shaped abutment section that surrounds the insertion hole 56 through which the screw 32 is inserted, project from the underside of the base 42. The second annular projections 60 are formed concentrically with the third annular projection 56*a* so as to project around the outer circumference of the third annular projection 56*a*. The third annular projection 56*a* has a length equal to that of the second annular projection 60 in the axial direction Z.

The first annular projection 59 has a length longer than that of the second annular projection 60 in the axial direction Z and shorter than that of the connection member 43. The second annular projection 60 has a thickness in the radial direction of the screw 28 greater than that of the first annular projection 59 thereby having a rigidity higher than that of the first annular projection 59.

When the flow channel unit 25 is formed by securing the reinforcement member 31 to the flow channel forming member 30, the second annular projection 60 and the third annular projection 56*a* that project from the underside of the base 42 abut the reinforcement member 31 such that the reinforcement member 31 is positioned in the axial direction Z. Consequently, the reinforcement member 31 is secured to the flow channel forming member 30 spaced apart from the base 42 in the axial direction Z by the distance of the length of the second annular projection 60 or the third annular projection 56*a*.

Figure 6:
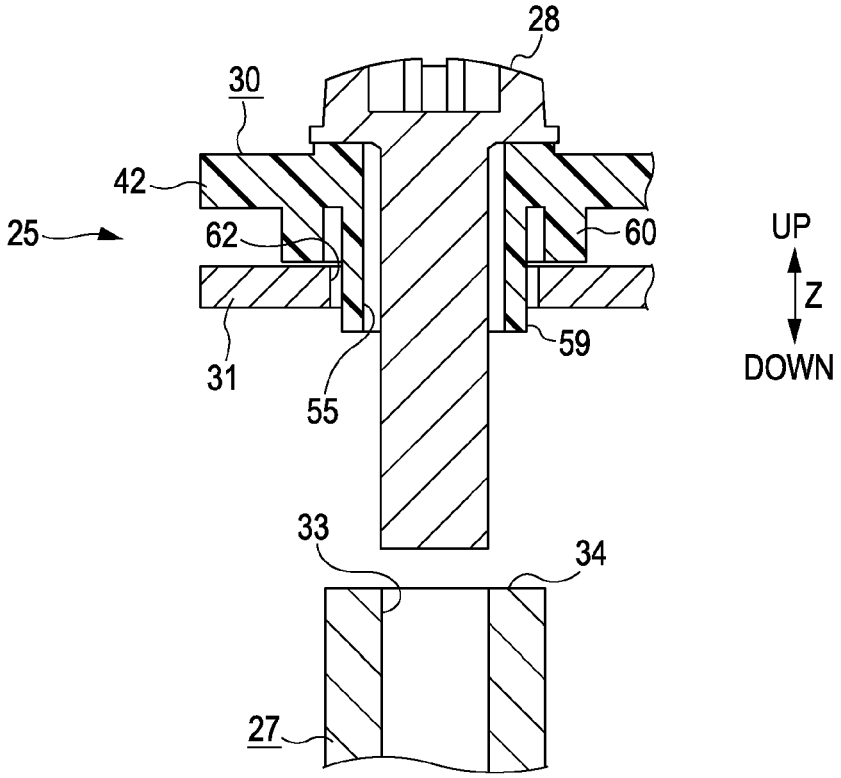
FIG. 6 is a sectional view showing a configuration around a screw section in the liquid ejection head unit.
Figure 7:
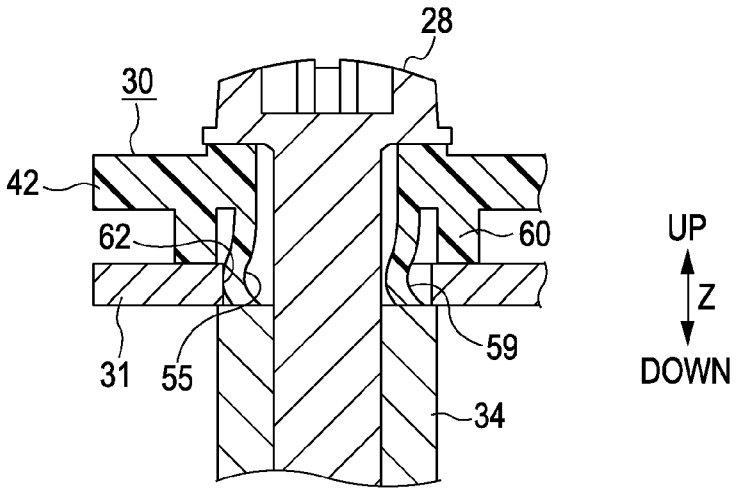
FIG. 7 is a sectional view showing an operation of a flow channel unit screwed to a holding frame.

The length of the first annular projection 59 in the axial direction Z is defined such that the first annular projection 59 penetrates through the reinforcement member 31 and projects toward the holding frame 27 in the down direction when the reinforcement member 31 is secured to the flow channel forming member 30. That is, as shown in FIG. 6, the first annular projection 59 has a length longer than that of the reinforcement member 31 in the axial direction Z. When the flow channel unit 25 is screwed to the holding frame 27, the first annular projection 59 is collapsed and deformed by the rotation force generated from the screw 28 during screwing the screw 28 and a reaction force generated from the screw section 34 of the holding frame 27 as shown in FIG. 7.

Figure 8:
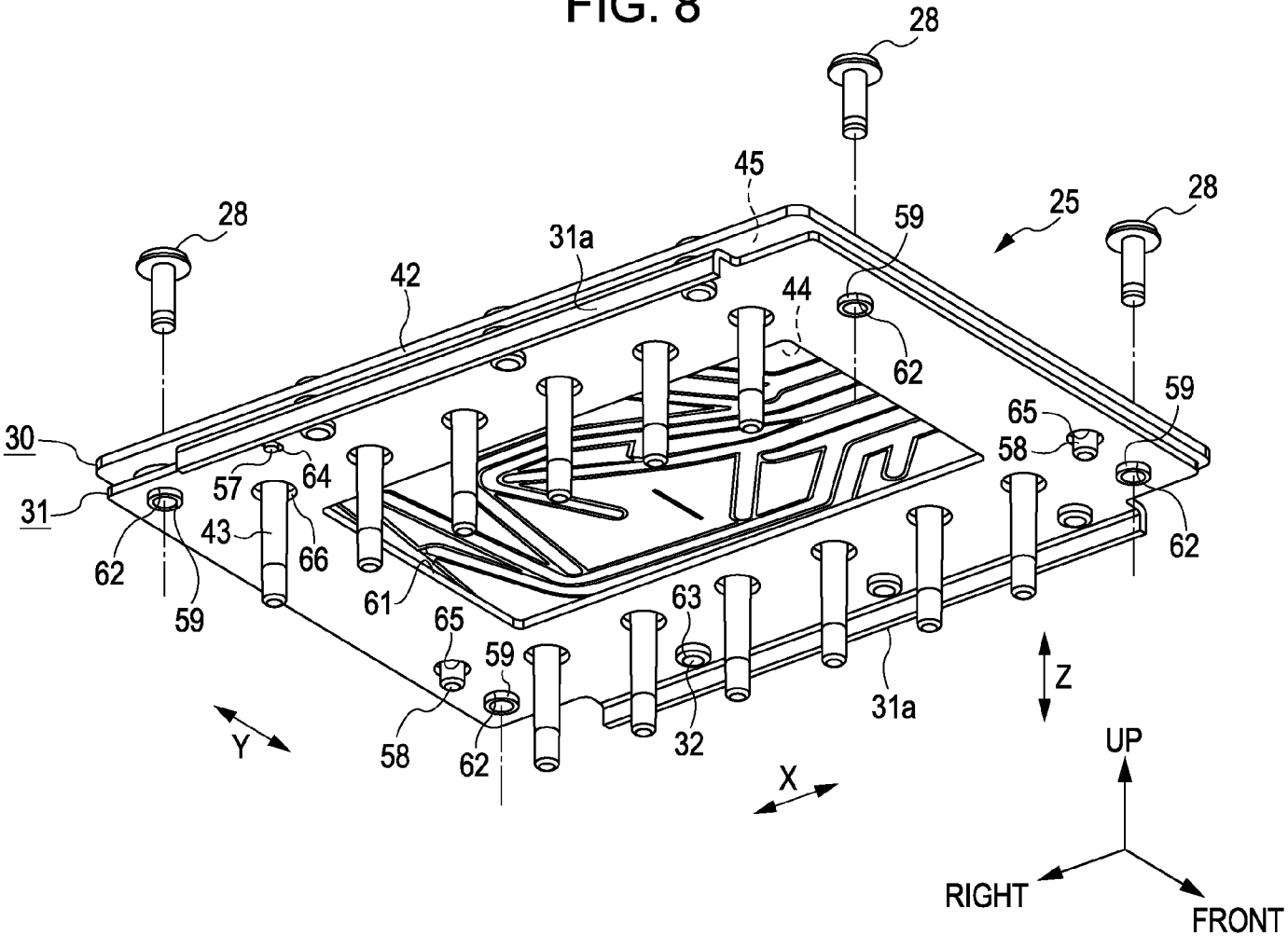
FIG. 8 is a perspective view of a flow channel unit that constitutes the liquid ejection head unit.

Next, the configuration of the reinforcement member 31 will be described below. As shown in FIG. 8, a bend portion 31*a* having a distal end bending downward is formed on each of the front and back ends of the reinforcement member 31. Further, an aperture 61 is formed at the approximate center of the reinforcement member 31 which corresponds to the flow channel forming area 44 disposed on the base 42 of the flow channel forming member 30. The flow channel unit 25 is formed when the reinforcement member 31 is secured to the flow channel forming member 30 so as to be parallel to the base 42 of the flow channel forming member 30 and oppose the non-flow channel forming area 45 of base 42.

Four insertion holes 62 through which the screws 28 are inserted are disposed at positions that substantially correspond to the four corners of the reinforcement member 31. The inner diameter of the insertion hole 62 is smaller than the outer diameter of the first annular projection 59 which projects from the base 42 of the flow channel forming member 30. Further, three pairs of screw holes 63 are formed in the main scan direction X at positions between the bend portion 31*a* and the aperture 61 of the reinforcement member 31.

Figure 9:
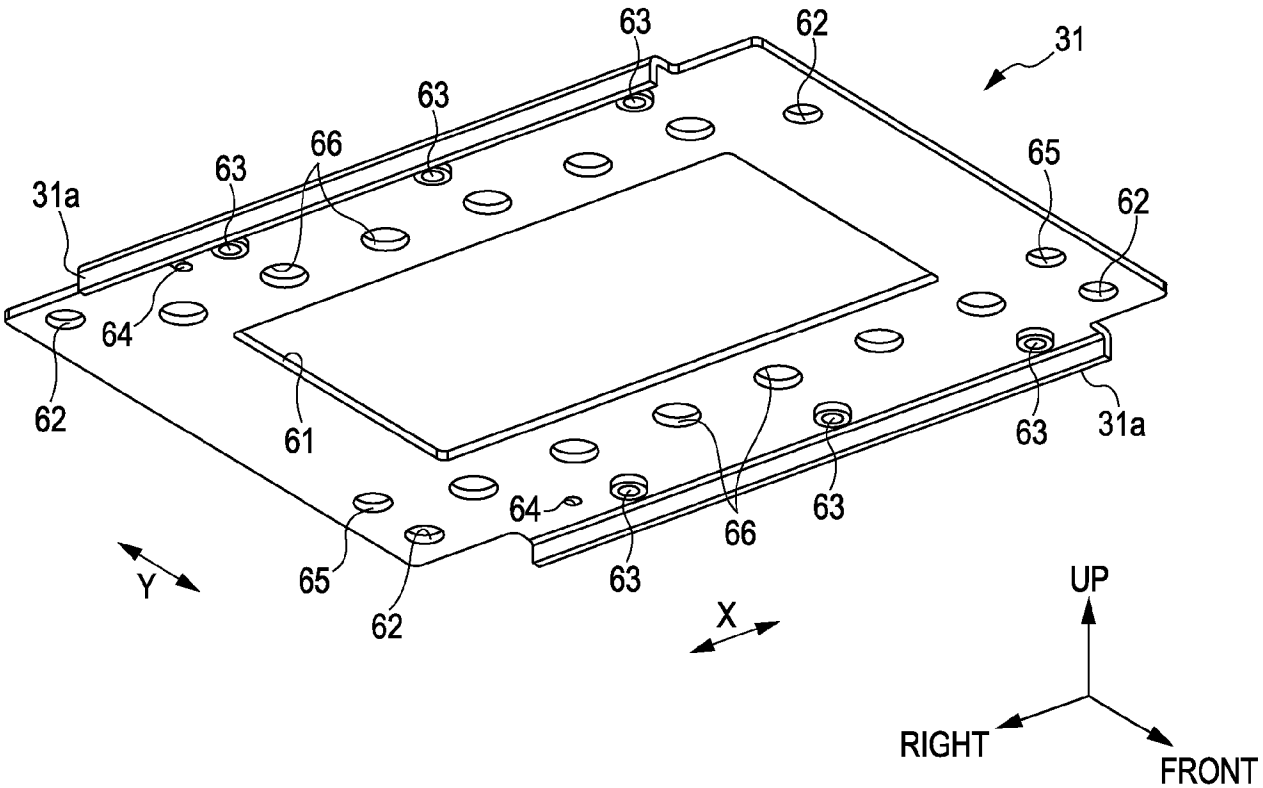
FIG. 9 is a perspective view of a reinforcement member that constitutes the flow channel unit.

Two first registration holes 64 through which the first registration projections 57 of the flow channel forming member 30 are inserted are disposed on the reinforcement member 31 at positions close to the right end and are arranged in the transportation direction Y (also see FIG. 9). Further, two second registration holes 65 through which the second registration projections 58 of the flow channel forming member 30 are inserted are disposed on the reinforcement member 31 at positions close to the front end and are arranged in the transportation direction Y.

A plurality of (in this embodiment, twelve) through holes 66 through which the connection member 43 of the flow channel forming member 30 are inserted are formed on the reinforcement member 31. The inner diameter of the through hole 66 is slightly greater than the outer diameter of the connection member 43 such that a gap is formed between the connection member 43 and the through hole 66 when the connection member 43 is inserted.

Next, a method for securing the flow channel forming member 30 to the liquid ejection head 26 will be described below. In an assembly process, an operator assembles first places the reinforcement member 31 under the flow channel forming member 30, inserts the connection member 43 of the flow channel forming member 30 into the through hole 66 of the reinforcement member 31 and assembles the reinforcement member 31 to the flow channel forming member 30 so as to be parallel to the base 42.

Here, the operator inserts the first registration projection 57 and the second registration projection 58 of the flow channel forming member 30 into the first registration hole 64 and the second registration hole 65 of the reinforcement member 31, respectively, thereby positioning the reinforcement member 31 in the horizontal direction. The operator also inserts the first annular projection 59 of the flow channel forming member 30 into the insertion hole 62 of the reinforcement member 31 so that the second annular projection 60 and the third annular projection 56*a* of the flow channel forming member 30 abut the reinforcement member 31, thereby positioning the reinforcement member 31 in the axial direction Z.

Then, in a first securing process, the operator inserts the screw 32 into the insertion hole 56 of the flow channel forming member 30 from the upper side, and then, rotates the screw 32 with the distal end of the screw 32 abutting the screw hole 63 of the reinforcement member 31. The operator then secures the reinforcement member 31 to the flow channel forming member 30 so as to be parallel to the base 42 by the tightening force of the screw 32. As a consequence, the flow channel unit 25 is formed by the flow channel forming member 30 and the reinforcement member 31 that are secured to each other by using the screw 32.

Then, in a connection process, the operator grabs the pair of the bend portions 31*a* of the reinforcement member 31 with his/her both hands, brings the flow channel unit 25 close to the holding frame 27 in the axial direction Z and insertedly connects each pair of connection members 43 of the flow channel forming member 30 to the corresponding two connection holes 38 (38A, 38B) of the liquid ejection head 26, respectively.

Here, the operator inserts the second registration projection 58 of the flow channel forming member 30 into the registration hole 29 of the holding frame 27, thereby positioning the flow channel unit 25 in the horizontal direction.

Then, in a second securing process, the operator secures the flow channel unit 25 to the holding frame 27 by screwing the screw 28. As a consequence, the flow channel forming member 30 is secured to the holding frame 27 while the liquid supplying flow channels 46 are connected to the corresponding liquid ejection heads 26 and thus the assembly of the liquid ejection head unit 24 is completed. After the insertion connection of the connection members 43 to the connection holes 38 is completed, connection section between the connection member 43 and the connection hole 38 is sealed by using the sealing member 39.

Then, operation of the printer 11 and the liquid ejection head unit 24 according to this embodiment will be described below. Although the base 42 of the flow channel forming member 30 is preferably thinner in order to achieve a smaller liquid ejection head unit 24, deformation such as warpage is more likely to occur as the thickness of the base 42 is reduced. In particular, when the base 42 is made of a resin material, and the liquid supplying flow channels 46 are formed by covering the base 42 with the film members 50, 53 affixed thereto, deformation of the base 42 is more likely to occur.

In the liquid ejection head unit 24 according to this embodiment, the reinforcement member 31 which has a rigidity higher than that of the flow channel forming member 30 is assembled to the flow channel forming member 30 in the first securing process, thereby correcting such deformation of the base 42. Then, the connection members 43 that extend from the base 42, whose deformation has been corrected, are connected to the connection holes 38 of the liquid ejection heads 26. This suppresses displacement of the liquid ejection head 26 due to a pressing force which may be generated if the flow channel forming member 30 having deformed base 42 is connected.

Moreover, in the connection process, the operator grabs the pair of the bend portions 31*a* of the reinforcement member 31 with his/her both hands and brings the flow channel unit 25 close to the holding frame 27 in the axial direction Z. Accordingly, the twelve connection members 43 are insertedly connected to the corresponding connection holes 38, respectively. As a result, connection of a plurality of pairs of the liquid supplying flow channels 46 and the liquid ejection heads 26 are simultaneously achieved.

Although the liquid ejection heads 26, whose positions have been adjusted with respect to each other, are assembled to the holding frame 27 by using securing members such as screws, the position of the connection member 43 relative to the connection hole 38 may be displaced due to a manufacturing tolerance of the connection hole 38 or the connection member 43. This leads to the connection member 43 which is slightly bent by the amount of the displacement to be connected to the connection hole 38. However, such bending deformation of the connection member 43 is acceptable, since gaps are formed between the through hole 66 of the reinforcement member 31 and the connection member 43 and between the reinforcement member 31 and the base 42, respectively.

Since the connection members 43 are independently formed, the connection members 43 have a lower rigidity compared to the case where the connection members 43 are connected with each other and integrally formed. This suppresses displacement of the liquid ejection head 26 that is secured to the holding frame 27 for example by using screws, even if a pressing force which may be generated when the slightly bent connection member 43 is connected to the connection hole 38 is applied to the liquid ejection head 26.

In the second securing process, the liquid ejection head 26 whose position has been adjusted may be displaced due to the rotation force of the screw 28 which is transferred to the screw section 34 of the holding frame 27 and causes the holding frame 27 to rotate with the screw 28. In this embodiment, the rotation force of the screw 28 is absorbed when the first annular projection 59 that projects from the base 42 of the flow channel forming member 30 is collapsed and deformed. This suppresses the displacement of the liquid ejection head 26 caused by rotation of the holding frame 27.

Further, when the assembled liquid ejection head unit 24 is mounted to the carriage 20 and printing operation is performed to the sheet P, the liquid ejection head 26 may generate heat for example by driving elements to eject ink. Such heat is transferred to ink in the liquid supplying flow channel 46 via the holding frame 27 and the reinforcement member 31 that are made of a metal material, which may cause the properties of ink to be altered due to change in temperature.

In the liquid ejection head unit 24 according to this embodiment, the reinforcement member 31 is formed in a plate-like shape, ensuring a large surface area, thereby promoting heat dissipation. Moreover, the base 42 of the flow channel forming member 30 on which the liquid supplying flow channels 46 are formed is in contact with the reinforcement member 31 with the third annular projection 56*a* and the second annular projection 60 interposed therebetween, thereby suppressing the heat transfer from the reinforcement member 31 to the flow channel forming member 30. In addition to that, the aperture 61 is formed on the reinforcement member 31 at a position that corresponds to the flow channel forming area 44, thereby suppressing the heat transfer from the reinforcement member 31 to the liquid supplying flow channels 46.

When the flow channel unit 25 is removed from the holding frame 27 for example for maintenance of the liquid ejection head 26, the operator can grab the pair of bend portions 31*a* of the reinforcement member 31 with his/her both hands and lift the flow channel unit 25 to a position above the holding frame 27. Moreover, the second annular projections 60 project from the underside of the base 42 which opposes the reinforcement member 31 in a direction toward the reinforcement member 31. The second annular projections 60 are disposed in pairs with one of each pair being arranged on the front edge and the other on the back edge of the base 42 opposing with each other.

Accordingly, even if bending of the reinforcement member 31 occurs when the flow channel unit 25 is lifted, the pair of second annular projection 60 abuts the reinforcement member 31, thereby suppressing the bending of the base 42. Further, if the close attaching of the sealing member 39 causes a resistance to pull out the connection member 43 from the connection hole 38, the flow channel unit 25 can be lifted in the axial direction Z while retaining the base 42 to be horizontal. When the flow channel unit 25 is removed from the holding frame 27 while retaining the base 42 to be horizontal, the connections between a plurality of the liquid ejection heads 26 and the liquid supplying flow channels 46 are almost simultaneously released.

According to the above-mentioned embodiment, the following effect can be obtained.

(1) A plurality of tubular connection members 43 that extend from one side (the underside) of the base 42 can be insertedly connected to the respective connection holes 38 formed on the corresponding liquid ejection heads 26 by moving the base 42 of the flow channel forming member 30 in an extending direction (the axial direction Z) of the connection member 43, thereby enabling connection operation of a plurality of pairs of the liquid ejection heads 26 and the liquid supplying flow channels 46 to be simultaneously achieved. Therefore, connection operation of the flow channels with the liquid ejection head unit 24 can be simplified, compared with the case of connecting each branch flow channel forming member of a plurality of branch flow channel forming members formed by flexible tubes one by one to the connection hole 38 of the corresponding liquid ejection head 26.

(2) The connection members 43 are each formed as a pipe tube independently extend in parallel to each other, which differ from those formed by flexible tubes, thereby enabling the connection members 43 to be insertedly connected to the corresponding connection holes 38 with ease, while suppressing a significant bending. Too high rigidity of the connection member 43 may contribute to displacement of the liquid ejection head 26, which occurs due to a pressing force generated during insertion connection, if the liquid ejection head 26 or the connection member 43 has a manufacturing tolerance. The connection members 43, which independently extend in parallel to each other, have a lower rigidity compared to the case where the connection members 43 are connected with each other and integrally formed. Therefore, even if intervals between the positions of the liquid ejection heads 26 or the positions of the connection holes 38 have a tolerance, displacement of the liquid ejection heads 26 can be suppressed by a slight bending of the connection member 43.

(3) Deformation such as warpage which may occur as the thickness of the base 42 is reduced can be corrected by the reinforcement member 31. This makes it possible to achieve a small-sized apparatus with the thinner base 42 and suppress displacement of the liquid ejection head 26 due to a pressing force which may be generated if the flow channel forming member 30 having deformed base 42 is connected. Further, when the connection member 43 is inserted into the through hole 66, bending of the connection member 43 connected with the liquid ejection head 26 is acceptable, since a gap is formed between the through hole 66 and the connection member 43 in the radial direction of the connection member 43. Therefore, even if the liquid ejection head 26 or the connection member 43 has a manufacturing tolerance or the like, the connection member 43 may have a slight bending when the liquid ejection head 26 is connected to the connection hole 38, thereby enabling to suppress displacement of the liquid ejection heads 26.

(4) When the reinforcement member 31 is secured, a gap can be formed between the base 42 and the reinforcement member 31 in an extending direction of the connection member 43 by the third annular projection 56*a* and the second annular projection 60 of the base 42 abutting the reinforcement member 31, thereby permitting bending of the connection member 43 connected with the liquid ejection head 26. Therefore, even if the liquid ejection head 26 or the connection member 43 has a manufacturing tolerance or the like, the connection member 43 may have a slight bending when the liquid ejection head 26 is connected to the connection hole 38, thereby enabling to suppress displacement of the liquid ejection heads 26.

(5) Deformation such as warpage which may occur as the thickness of the base 42 is reduced can be corrected by securing the reinforcement member 31 to the flow channel forming member 30. Further, since the reinforcement member 31 is made of a material having a rigidity higher than that of the base 42, the apparatus can be reduced in size by securing the reinforcement member 31 to the base 42 in parallel to the base 42, rather than by increasing the thickness of the base 42 to such an extent that deformation of the base 42 can be suppressed. Therefore, it is possible to achieve a small-sized apparatus with the thinner base 42 and suppress displacement of the liquid ejection head 26 due to a pressing force which may be generated if the flow channel forming member 30 having deformed base 42 is connected.

(6) The reinforcement member 31 is disposed between the liquid ejection head 26 and the base 42, and the operator connects/disconnects the flow channel forming member 30, grabbing the reinforcement member 31, therefore deformation of the base 42 during connection/disconnection can be suppressed.

(7) Although the base 42 may deform when the film member 50, 53 is affixed thereto, deformation of the base 42 can be corrected by securing the reinforcement member 31 to the flow channel forming member 30.

(8) The reinforcement member 31 is grounded via the holding frame 27 when secured to the holding frame 27, therefore it is possible to suppress electrostatic charge by establishing a discharge path for static electricity of the reinforcement member 31 and suppress generation of electromagnetic noise. Moreover, when the liquid ejection head 26 generates heat, it is also possible to promote heat dissipation of the liquid ejection head 26 by transferring heat via the holding frame 27 to the reinforcement member 31 having a plate-like shape.

(9) When the operator removes the flow channel forming member 30 from the holding frame 27, grabbing the reinforcement member 31 with his/her both hands, the third annular projection 56*a* and the second annular projection 60 formed on the base 42 abut the reinforcement member 31, therefore bending of the base 42 can be suppressed.

(10) Deformation such as warpage of the base 42 of the flow channel forming member 30 can be corrected by using the reinforcement member 31 by securing the reinforcement member 31 to the flow channel forming member 30 with the screws 32. Then, the flow channel forming member 30 having the base 42 whose deformation has been corrected, integrally with the reinforcement member 31, is secured by the screws 28 to the holding frame 27 that holds the liquid ejection heads 26, thereby enabling to suppress displacement of the liquid ejection head 26. Therefore, it is possible to reduce the size of the apparatus by using the flow channel forming member 30 that has the base 42 having a plate-like shape, instead of the flexible tubes, and suppress displacement of the liquid ejection head 26.

(11) Deformation such as warpage of the base 42 can be corrected by securing the reinforcement member 31 to the flow channel forming member 30, and therefore, it is possible to achieve small-sized apparatus with the thinner base 42. The reinforcement member 31 is secured to the flow channel forming member 30 so as to oppose the non-flow channel forming area 45 on which the liquid supplying flow channels 46 are not formed. Accordingly, even if heat generated from the liquid ejection head 26 or the like is stored in the reinforcement member 31, heat transfer to the flow channel forming area 44 can be suppressed. Therefore, it is possible to reduce the size of the apparatus and suppress heat transfer to the liquid supplying flow channel 46.

(12) Since the non-flow channel forming area 45 is disposed at the peripheral area of the base 42 so as to surround the flow channel forming area 44 which is disposed at the approximate center of the base 42, deformation of the base 42 can be more uniformly corrected by securing the reinforcement member 31 to the non-flow channel forming area 45. Further, since the reinforcement member 31 has the aperture 61 at a position that corresponds to the flow channel forming area 44, heat transfer to the liquid supplying flow channel 46 can be suppressed by placing the flow channel forming area 44 and the reinforcement member 31 spaced apart. In addition, since the aperture 61 is formed at the approximate center of the reinforcement member 31, the reinforcement member 31 can be simplified in shape and the reinforcement member 31 can be of a light-weight.

(13) Since the reinforcement member 31 is disposed between the holding frame 27 and the base 42, it is possible to promote heat dissipation by the reinforcement member 31 and the holding frame 27 both having high heat conductivity, when the liquid ejection head 26 generates heat.

(14) When the reinforcement member 31 is secured to the flow channel forming member 30, the third annular projection 56*a* and the second annular projection 60 that project from the base 42 of the flow channel forming member 30 abut the reinforcement member 31, thereby positioning the reinforcement member 31. Accordingly, heat transfer from the reinforcement member 31 to the flow channel forming member 30 can be suppressed by reducing the contact area between the reinforcement member 31 and the base 42.

(15) During tightening of the screw 28, the first annular projection 59 is collapsed and deformed, thereby suppressing transmission of the rotation force to the holding frame 27 via the flow channel forming member 30. Consequently, the flow channel forming member 30 can be secured while suppressing displacement of the holding frame 27. As a result displacement of the liquid ejection head 26 can be suppressed when the flow channel forming member 30 is secured to the holding frame 27 that holds the liquid ejection heads 26 by using the tightening force of the screw 28.

(16) The first annular projection 59 is formed in an annular shape so as to surround the insertion hole 55, therefore the rotation force transmitted to the holding frame 27 in the rotation direction of the screw 28 can be uniformly suppressed.

(17) Three or more first annular projections 59 project from one side of the base 42 having a plate-like shape, therefore it is possible to secure the flow channel forming member 30 to the holding frame 27 by using the tightening force of the screw 28, while suppressing the inclination of the base 42.

(18) The first annular projection 59 has a length longer than that of the reinforcement member 31 in the axial direction Z of the screw 28, therefore it is possible that the first annular projection 59 abuts the holding frame 27 even if the reinforcement member 31 is placed between the flow channel forming member 30 and the holding frame 27.

(19) The second annular projection 60 has a length shorter than that of the first annular projection 59, and a rigidity higher than that of the first annular projection 59, therefore it is possible that the second annular projection 60 remains in the original shape when the first annular projection 59 is collapsed and deformed during tightening of the screw, thereby enabling the positioning of the reinforcement member 31.

The above-mentioned embodiment may be modified as follows:

The liquid ejection head unit 24 may not include the reinforcement member 31.

The liquid supplying flow channels 46 and the liquid ejection heads 26 may be connected by inserted connection between a connection member that extends from the liquid ejection head 26 and a connection hole that is formed on the flow channel forming member 30.

The securing members other than screws, for example clips, may be used to connect the flow channel forming member 30 and the reinforcement member 31 or the flow channel unit 25 and the holding frame 27.

The reinforcement member 31 and the flow channel forming member 30 may be secured each other by engagement between an engaging unit that projects from one of the flow channel forming member 30 and the reinforcement member 31 and an engaged unit that is formed on the other. Moreover, the flow channel unit 25 and the holding frame 27 may be secured each other by engagement between an engaging unit that projects from one of the flow channel unit 25 and the holding frame 27 and an engaged unit that is formed on the other.

The second annular projection 60 and the third annular projection 56*a* may not be provided on the flow channel forming member 30.

The first annular projection 59, the second annular projection 60 and the third annular projection 56*a* may not be provided on the flow channel forming member 30.

Some of a plurality of connection members 43 of the flow channel forming member 30 may have different length, and all or some of the connection members 43 may have a curved portion and partially not parallel to each other. In this case, if the distal end of the connection members 43 are at positions that correspond to the respective connection holes 38 and are parallel to each other, a plurality of connection members 43 can be simultaneously inserted and connected the corresponding connection holes 38.

The reinforcement member 31 may not have the aperture 61 or may have a plurality of aperture 61.

The flow channel forming member 30 may be made of a material other than a resin material, and the reinforcement member 31 and the holding frame 27 may be made of a material other than a metal material.

The first annular projection 59, the second annular projection 60 and the third annular projection 56*a* may be of any number or any arrangement. For example, the second annular projection 60 may be disposed, for example, on the side area of the base 42 of the flow channel forming member 30, rather than on the outer circumference of the first annular projection 59 or the third annular projection 56*a*. In addition, the first annular projection 59, the second annular projection 60 and the third annular projection 56*a* may be formed as a projection having any shape other than annular shape.

The base 42 of the flow channel forming member 30 may be disposed between the holding frame 27 and the reinforcement member 31. With this configuration, the base 42 made of a resin material is disposed between the holding frame 27 and the reinforcement member 31, thereby suppressing the heat from the liquid ejection head 26 to be transferred to the reinforcement member 31 via the metallic holding frame 27.

The first annular projection 59 which is collapsed and deformed by the rotation force applied from the screw 28 may project from the screw section 34 of the holding frame 27.

The connection holes 38 formed on the liquid ejection heads 26 may be of any number or any arrangement.

The printer may be on-carriage type printer, which uses the ink cartridges 15 loaded on the carriage 20. Alternatively, the printer is not limited to serial type printer, whose carriage 20 moves in the main scan direction X, and may be line head type or lateral type printer, which has the liquid ejection head 26 at a fixed position while performing printing in the maximum sheet width. Further, ink jet label printers, bar code printers or ticket machines may be used.

The liquid ejecting apparatus is not limited to printer, but also include facsimile machines, copy machines, or multifunction machines having a plurality of functions. Further, liquid ejecting apparatuses that eject liquid other than ink may be included. The invention may be applied to various liquid ejecting apparatuses having a liquid ejecting head or the like that ejects fine liquid droplets. It is noted that the liquid droplets means a state of liquid that is ejected from the liquid ejecting apparatuses and are intended to include those in a particle, tear drop or string shape. Further, the liquid as described herein may be any material that can be ejected from liquid ejecting apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejecting apparatus may include, for example, liquid ejecting apparatuses that eject liquid containing materials such as electrode material and color material in a dispersed or dissolved state, which are used for manufacturing of liquid crystal displays, EL (electroluminescence) displays, surface emitting displays or color filters, liquid ejecting apparatuses that eject bioorganic materials used for manufacturing biochips, liquid ejecting apparatuses that are used as a precision pipette and eject liquid of a sample, textile printing apparatuses and micro dispensers. Further, examples of fluid ejecting apparatus may also include liquid ejecting apparatuses that eject lubricant to precision instrument such as a clock or camera in a pinpoint manner, liquid ejecting apparatuses that eject transparent resin liquid such as ultraviolet cured resin onto a substrate for manufacturing of minute hemispheric lenses (optical lenses) used for optical communication elements or the like, and liquid ejecting apparatuses that eject acid or alkali etching liquid for etching a substrate or the like.

The entire disclosure of Japanese Patent Application No. 2010-285977, filed Dec. 22, 2010, 2010-285978, filed Dec. 22, 2010, 2010-285979, filed Dec. 22, 2010, 2010-285980, filed Dec. 22, 2010 and 2010-285981, filed Dec. 22, 2010 are expressly incorporated by reference herein.

What is claimed is:

1. A liquid supplying mechanism comprising:

a flow channel forming member that has a base having a plate-like shape on which an upstream portion of a plurality of liquid supplying flow channels is formed so as to supply liquid to each of a plurality of liquid ejection heads that are assembled in a liquid ejection head unit, and a plurality of connection members in a tubular shape that extend from one side of the base so as to form a downstream portion of flow channels that individually communicate with the upstream portion of the respective liquid supplying flow channels and are disposed such that the distal end of connection members correspond to the positions of the connection holes that are formed on the respective liquid ejection heads, and a reinforcement member having a plate-like shape that is made of a material having a rigidity higher than that of the flow channel forming member and is secured to the flow channel forming member so as to be parallel to the base.

2. The liquid supplying mechanism according to claim 1, wherein the connection members which are each formed as a pipe tube independently extend in parallel from positions spaced apart from each other at a distance corresponding to the positions of the respective liquid ejection heads on the one side of the base.

3. A liquid ejecting apparatus comprising:

a liquid ejection head unit in which a plurality of liquid ejection heads are assembled; and the liquid supplying mechanism according to claim 2.

4. The liquid supplying mechanism according to claim 1, wherein an abutment section projects from the one side of the base and has a length in an extending direction of the connection member which is shorter than a length of the connection member, and the abutment section abuts the reinforcement member when the reinforcement member is secured, thereby positioning the reinforcement member with respect to the flow channel forming member in the extending direction.

5. A liquid ejecting apparatus comprising:

a liquid ejection head unit in which a plurality of liquid ejection heads are assembled; and the liquid supplying mechanism according to claim 4.

6. The liquid supplying mechanism according to claim 1, wherein a plurality of through holes through which the connection members are inserted are formed on the reinforcement member, and each of the through holes has an inner diameter slightly larger than an outer diameter of the connection members such that a gap is formed between the connection members and the through holes when the connection members are inserted.

7. A liquid ejecting apparatus comprising:

a liquid ejection head unit in which a plurality of liquid ejection heads are assembled; and the liquid supplying mechanism according to claim 3.

8. A liquid ejecting apparatus comprising:

a liquid ejection head unit in which a plurality of liquid ejection heads are assembled; and the liquid supplying mechanism according to claim 1.

9. A liquid supplying mechanism comprising:

a flow channel forming member that has a base on which an upstream portion of a plurality of liquid supplying flow channels is formed so as to supply liquid to each of a plurality of liquid ejection heads that are assembled in a liquid ejection head unit;

a plurality of connection members in a tubular shape that extend from one side of the of the base so as to form a downstream portion of flow channels that individually communicate with the upstream portion of the respective liquid supplying flow channels and are disposed such that the distal end of the connection members correspond to the positions of the connection holes that are formed on the respective liquid ejection heads; and a reinforcement member that is made of a material having a rigidity higher than that of the flow channel forming member and is secured to the flow channel forming member so as to be disposed between the liquid ejection heads and the base.

10. A liquid ejecting apparatus comprising:

a liquid ejection head unit in which a plurality of liquid ejection heads are assembled; and the liquid supplying mechanism according to claim 9.

* * * * *